US007164089B2

(12) United States Patent
Chen

(10) Patent No.: US 7,164,089 B2
(45) Date of Patent: Jan. 16, 2007

(54) THIN KEYBOARD STRUCTURE

(75) Inventor: Chi-Hung Chen, Taipei (TW)

(73) Assignee: ASUSTeK Computer Inc., Taipei (TW)

( * ) Notice: Subject to any disclaimer, the term of this patent is extended or adjusted under 35 U.S.C. 154(b) by 0 days.

(21) Appl. No.: 11/398,184

(22) Filed: Apr. 5, 2006

(65) Prior Publication Data

US 2006/0243567 A1 Nov. 2, 2006

(30) Foreign Application Priority Data

Apr. 28, 2005 (TW) ..... 94113727 A

(51) Int. Cl.
*H01H 9/26* (2006.01)
*H01H 13/72* (2006.01)
*H01H 13/76* (2006.01)

(52) U.S. Cl. ..... 200/5 A; 200/511; 200/512

(58) Field of Classification Search ..... 200/5 A
See application file for complete search history.

(56) References Cited

U.S. PATENT DOCUMENTS 5,767,464 A * 6/1998 Dyer et al. ..... 200/5 A
5,879,088 A * 3/1999 English ..... 400/481
7,005,596 B1 * 2/2006 Maeda et al. ..... 200/314
7,060,923 B1 * 6/2006 Pihlaja ..... 200/512

* cited by examiner

*Primary Examiner*—Elvin Enad
*Assistant Examiner*—Lheiren Mae A. Anglo
(74) *Attorney, Agent, or Firm*—Thomas, Kayden, Horstemeyer & Risley

(57) ABSTRACT

A thin keyboard structure comprises a substrate, a flexible circuit and a keycap. The substrate comprises a base, a first portion with a first end, and a second portion with a second end. At least one of the first portion and the second portion protrudes from the base at an included angle. The first end is aligned with the second end and separated from the second end by some distance. The flexible circuit comprises a first contact fixed on the first end and a second contact fixed on the second end. The keycap having at least one connecting device is fixed on the portion that protrudes from the base.

14 Claims, 8 Drawing Sheets

THIN KEYBOARD STRUCTURE

RELATED APPLICATIONS

The present application is based on, and claims priority from, Taiwan Application Serial Number 94113727, filed Apr. 28, 2005, the disclosure of which is hereby incorporated by reference herein in its entirety.

FIELD OF THE INVENTION

The present invention relates to an electronic-intelligent product, more particularly to a keyboard structure of the same.

BACKGROUND OF THE INVENTION

Most electronic-intelligent products work according to the commands input by an operator. The keyboard is one of the most popular input devices for electronic-intelligent products such as notebook computers, portable TVs, cell phones, and personal digital assistants (PDAs).

FIG. 1 illustrates a cross-sectional view of a piezoelectric structure within a prior art keyboard. Typically, a keyboard is composed of a plurality of keycaps and a piezoelectric structure beneath the keycaps, wherein the piezoelectric device comprises at least one elastic element 101, an upper flexible printed circuit 103, a separating sheet 105, and a bottom flexible printed circuit 107. The separating sheet 105 separates the upper flexible printed circuits 103 and the bottom flexible printed circuits 107. The upper flexible printed circuits 103 and the bottom flexible printed circuits 107 have conducting points respectively. Each conducting point located on the upper flexible printed circuit 103 corresponds with a conducting point located on the bottom flexible printed circuit 107, and the conducting points can contact each other via a corresponding through-hole formed in the separating sheet 105. Each of the through-holes and two corresponding conducting points is aligned with a keycap. For example, the conducting point 119*a* located on the upper flexible printed circuit 103 and the conducting point 119*b* located on the bottom flexible printed circuit 107 may contact via the through-hole 105*a* formed in the separating sheet 105. Each of the elastic elements 101 may be a block of elastic material beneath the keycap, for example a block of rubber, and has a protuberance 101*a* aligned with a through-hole 105*a* and the corresponding conducting points 109*a* and 109*b*. When the keycap is pressed to push the elastic element 101 downward, the protuberance 101a pushes the corresponding conducting point 109*a* through the through-hole 105*a* and makes electrical contact with the conducting point 109*b* to generate an electrical signal.

FIG. 2 is an exploded diagram of a keycap structure within a prior art keyboard. The keycap structure further comprises a supporting unit that is shaped like a pair of scissors or a bridge. For example, the scissors-shaped supporting unit is composed of a first supporting plate 213 and a second supporting plate 215 that are assembled to support the elastic elements 101 and connect a keycap 200 to the corresponding piezoelectric structure beneath the elastic elements 101.

However, using the scissors-shaped supporting unit not only expends much material and assembly time but also occupies significant space, space that customers demand to be as small as possible. Therefore, it is desirable to provide a thin keyboard structure that can be assembled easily and costs less to manufacture than the prior art.

SUMMARY OF THE INVENTION

The objective of the present invention is to provide a thin keyboard structure that has the advantages of being easily assembled and complying with the trend of with the trend of miniaturization.

In a preferred embodiment of the present invention, the thin keyboard structure comprises a substrate, a flexible circuit, and a keycap. The substrate comprises a base, a first portion with a first end and a second portion with a second end. The first portion and the second portion are connected with the base, wherein at least one of the first portion and the second portion protrudes from the base at an included angle. The first end is aligned with the second end and separated from the second end by some distance. At least one of the first portion and the second portion may be forced to deform, so that the first end can contact the second end. The flexible circuit comprises a first contact fixed on the first end and a second contact fixed on the second end. When the first end contacts the second end, the first contact and the second contact forms an electrical connection. The keycap having at least one connecting device is fixed on at least one of the first portion and the second portion protruding from the base.

When the keycap is forced to push the connecting device downward, at least one of the first portion and the second portion is deformed to create an electrical connection between the first contact and the second contact.

When releasing the forced keycap, the deformed portion returns to its native position by the elastic potential energy saved in the deformed portion, thus breaking the electrical connection between the first contact and the second contact.

Accordingly, the feature of the present invention is to use the elastic properties of the substrate rather than the elastic element of the prior art, such that the supporting element and the elastic element are made unnecessary. Furthermore, the circuits of the keyboard can be integrated onto a single flexible printed circuit.

Therefore, the cost and physical volume of the keyboard materials can be reduced to achieve the objectives of the present invention.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

The aspects, objective, features and many of the attendant advantages of this invention will become more readily appreciated by reference to the following detailed description.

Figure 1:
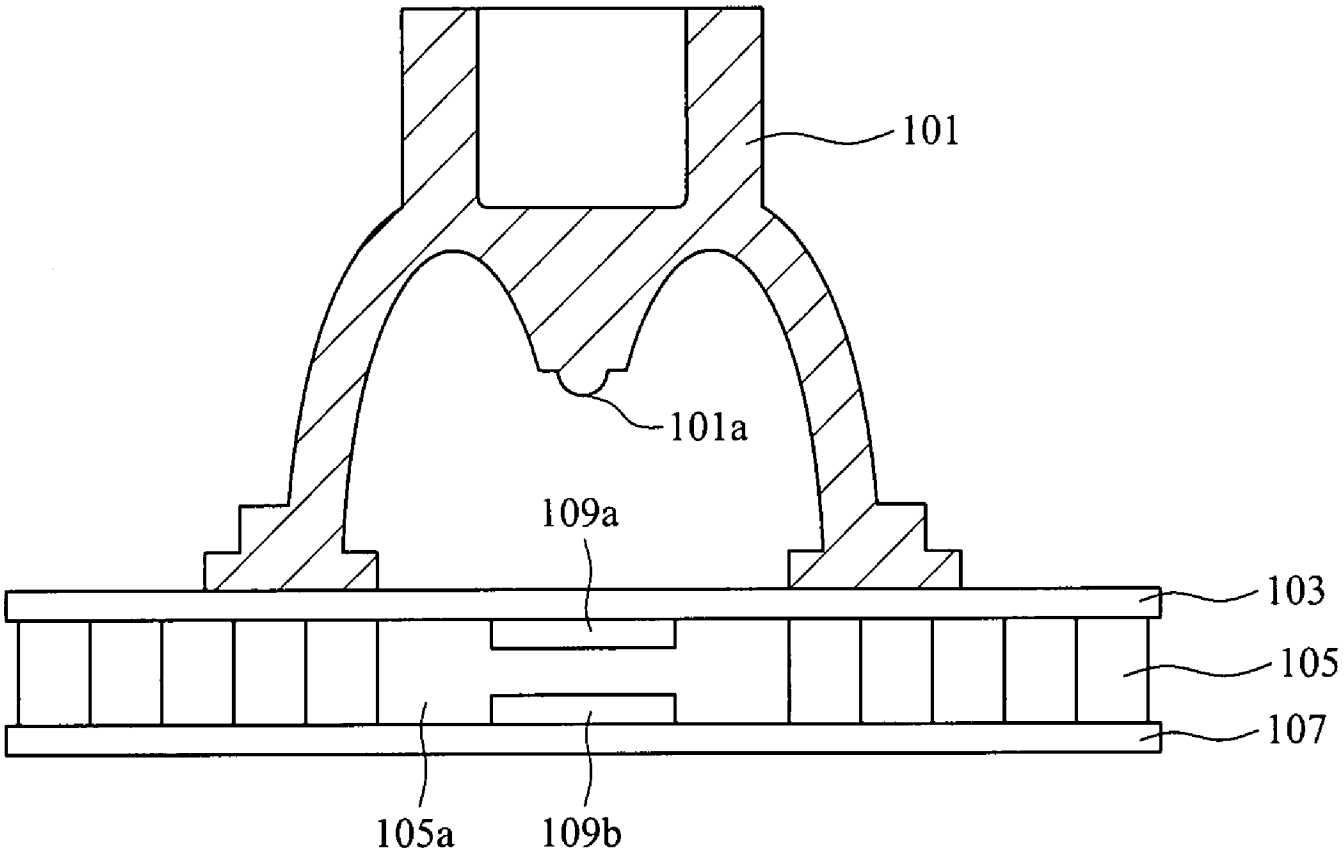
FIGURE. 1 (PRIOR ART)
FIG. 1 illustrates cross-sectional view of a piezoelectric structure within a prior art keyboard.
Figure 2:
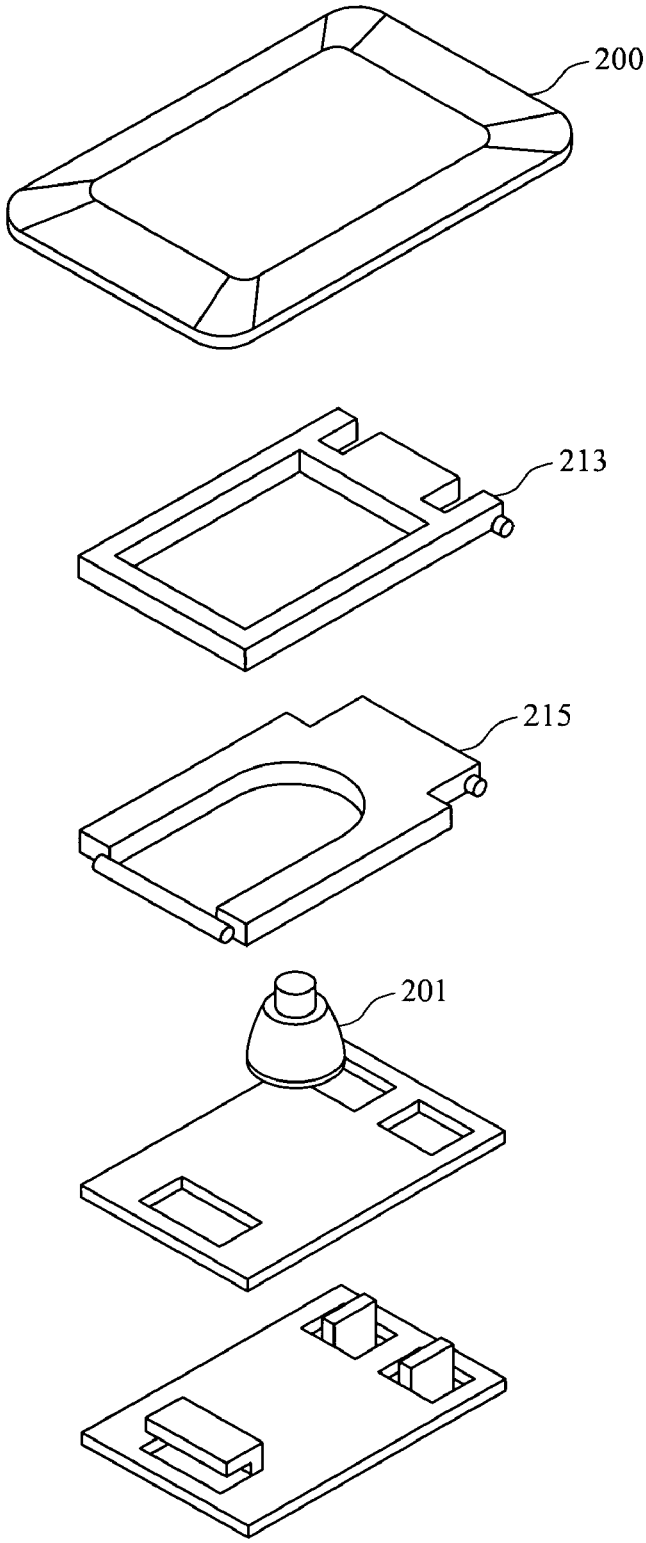
FIGURE. 2 (PRIOR ART)
FIG. 2 is an exploded diagram of a keycap structure within a prior art keyboard.
Figure 3A:
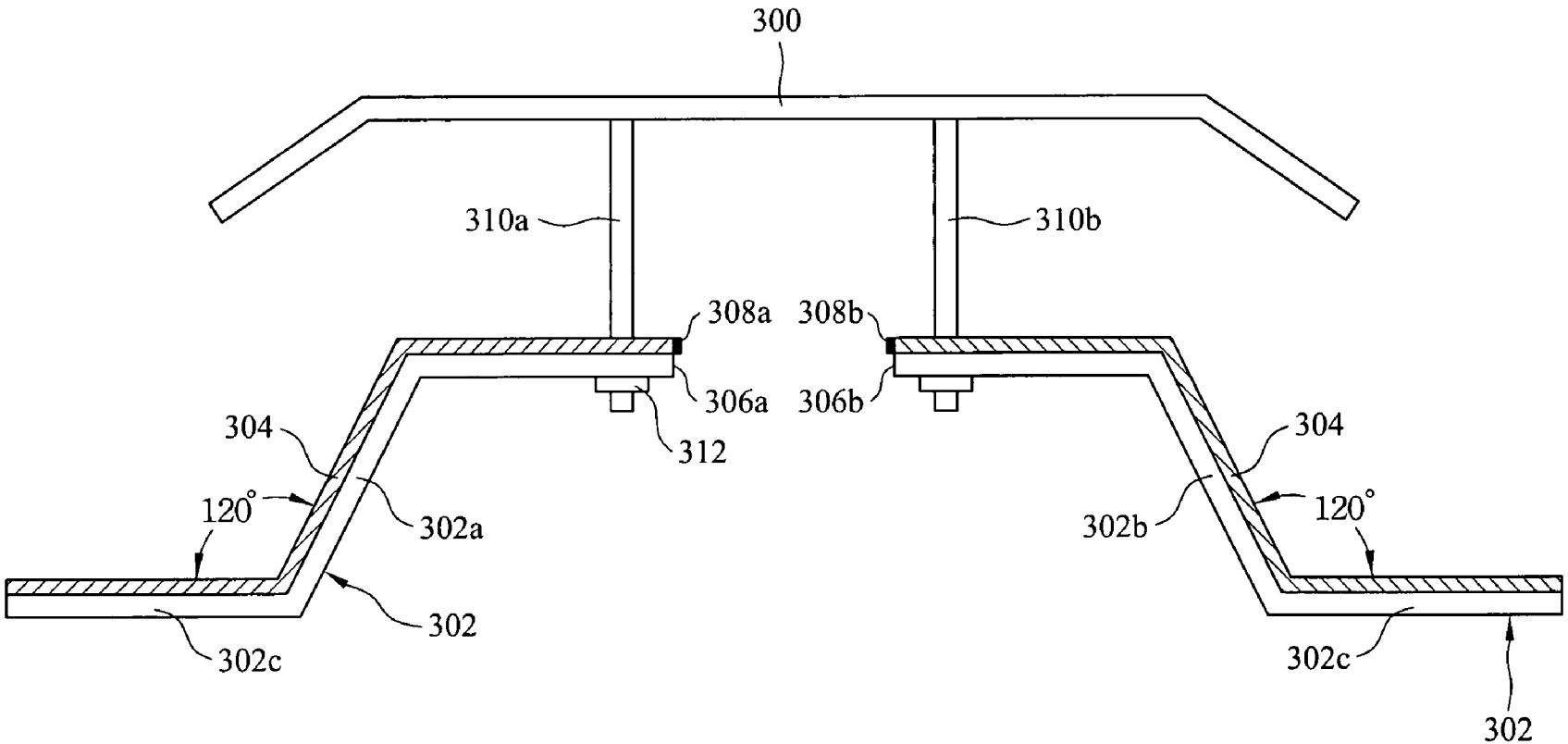
FIG. 3*a* illustrates a cross-sectional view of a thin keyboard structure, in accordance with the first preferred embodiment of the present invention.
Figure 3B:
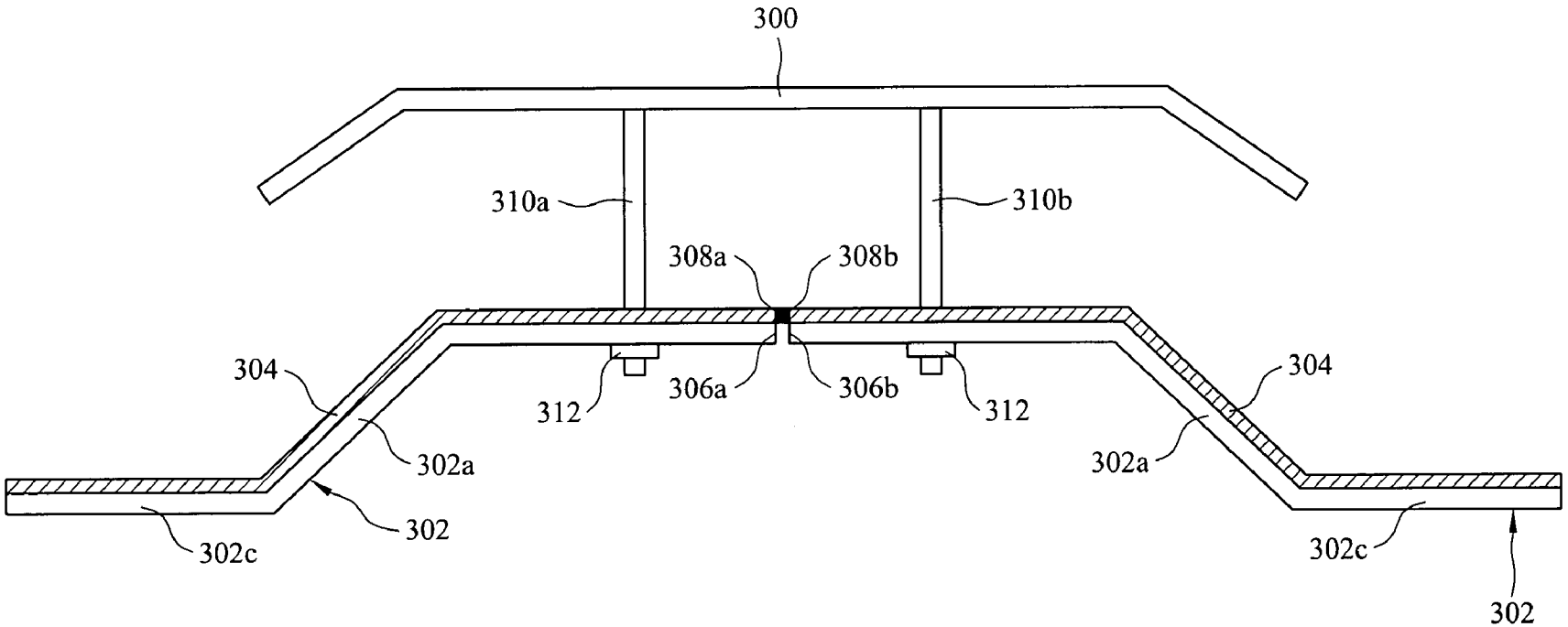
FIG. 3*b* is a cross-sectional view that illustrates the thin keyboard structure of FIG. 3*a* deformed by a force.

FIG. 3*a* illustrates a cross-sectional view of a thin press-button structure, in accordance with the first preferred embodiment of the present invention. FIG. 3*b* is a cross-sectional view that illustrates the thin press-button structure of FIG. 3*a* deformed by a force.

Referring to FIG. 3*a*, in the first preferred embodiment of the present invention, the thin keyboard structure comprises a substrate 302, a flexible circuit 304 and a keycap 300. The substrate 302 is made of a metal plate or a nonmetallic plate with elasticity, such as a plastic plate, an iron plate, an aluminum plate, a semiconductor plate or any arbitrary combination thereof. In the present embodiment, the substrate 302 is an elastic plate made of aluminum.

The substrate 302 comprises a base 302*c*, a first portion 302*a* with a first end 306*a*, and a second portion 302*b* with a second end 306*b*. The first portion 302*a* and the second portion 302*b* are connected with the base 302*c*, wherein at least one of the first portion 302*a* and the second portion 302*b* protrudes from the base 302*c* at an included angle of not equal to 90°. In the present embodiment, both of the first portion 302*a* and the second portion 302*b* protrude from the base 302*c*. There is an included angle between the first portion 302*a* and the base 302*c* and an included angle between the second portion 302*b* and the base 302*c*, wherein each of the two included angles is 120°. The thickness of the protruding portions (the first portion 302*a* and the second portion 302*b*) is substantially 0.3 mm.

The first end 306*a* is aligned with the second end 306*b* and separated from the second end 306*b* by a distance. At least one of the first portion 302*a* and the second portion 302*b* may be forced to deform to cause the first end 306*a* to contact the second end 306*b*.

The flexible circuit 304 comprises a first contact 308*a* fixed on the first end 306*a* and a second contact 308*b* fixed on the second end 306*b*. When the first end 306*a* contacts the second end 306*b*, the first contact 308*a* and the second contact 308*b* make an electrical connection. In the present embodiment, the flexible circuit 304 is a film circuit printed on the substrate 302. In some other embodiments of the present invention, the flexible circuit 304 is a flexible printed circuit fixed on the substrate 302. The first contact 308*a* and the second contact 308*b* may be two metal protuberances connected to the flexible circuit 304.

The keycap has at least one connecting device fixed on at least one of the first portion and the second portion by fastener elements. For example, the keycap 300 has two connecting devices 310*a* and 310*b* fixed on the first portion 302*a* and the second portion 302*b* by two fastener elements 312, respectively. In the present embodiment, the lengths of the connecting devices 310*a* and 310*b* are the same.

Referring to FIG. 3*b*, when the keycap 300 is forced to push the connecting devices 310*a* and 310*b* downward, the first portion 302*a* and the second portion 302*b* protruding from the substrate 302 are deformed to electrically connect the first contact 308*a* and the second contact 308*b*.

When releasing the forced keycap 300, the deformed portions 302*a* and 302*b* return to their native positions by the elastic potential energy saved in the deformed portions to electrically disconnect the first contact 308*a* and the second contact 308*b*.

Figure 4A:
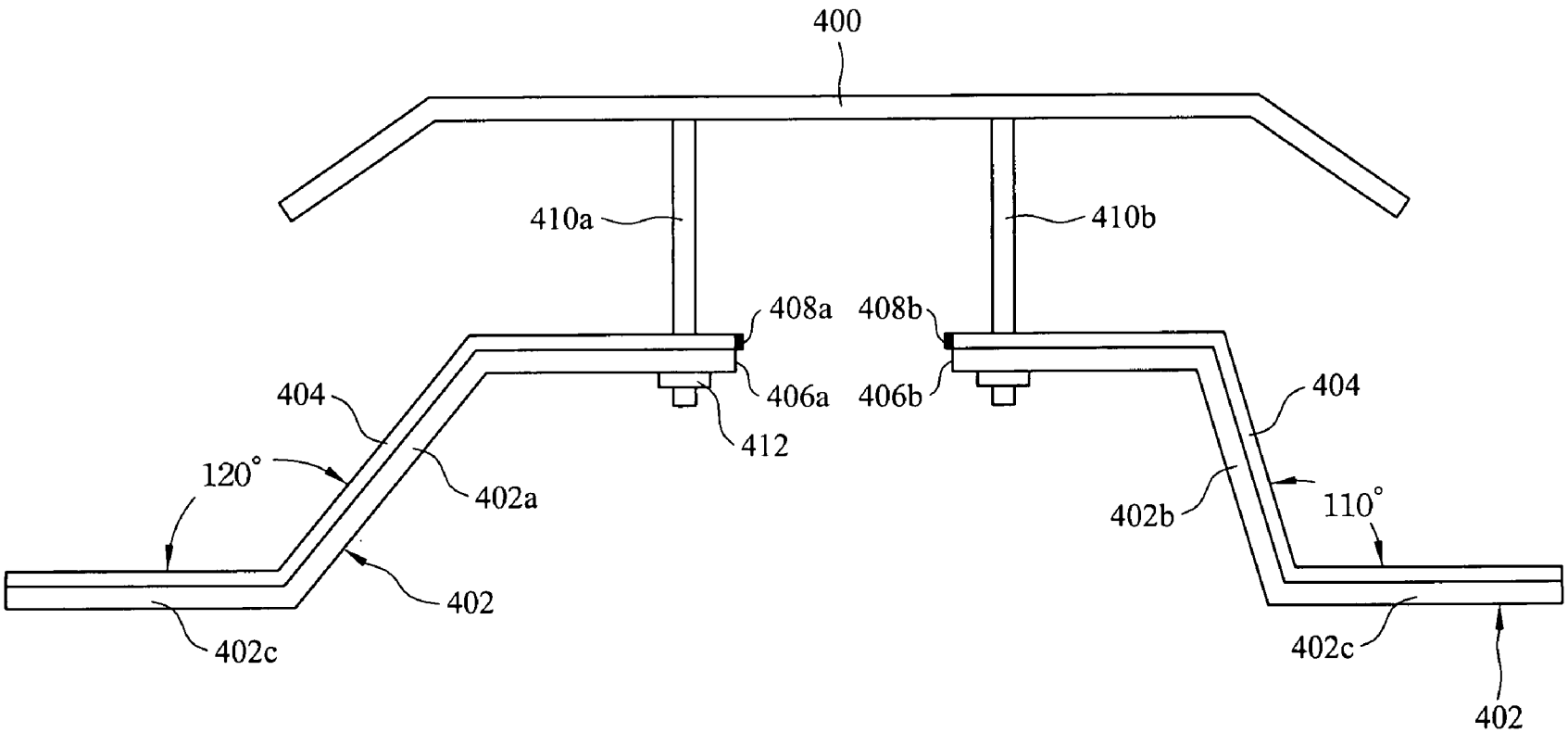
FIG. 4*a* illustrates a cross-sectional view of a thin keyboard structure, in accordance with the second preferred embodiment of the present invention.
Figure 4B:
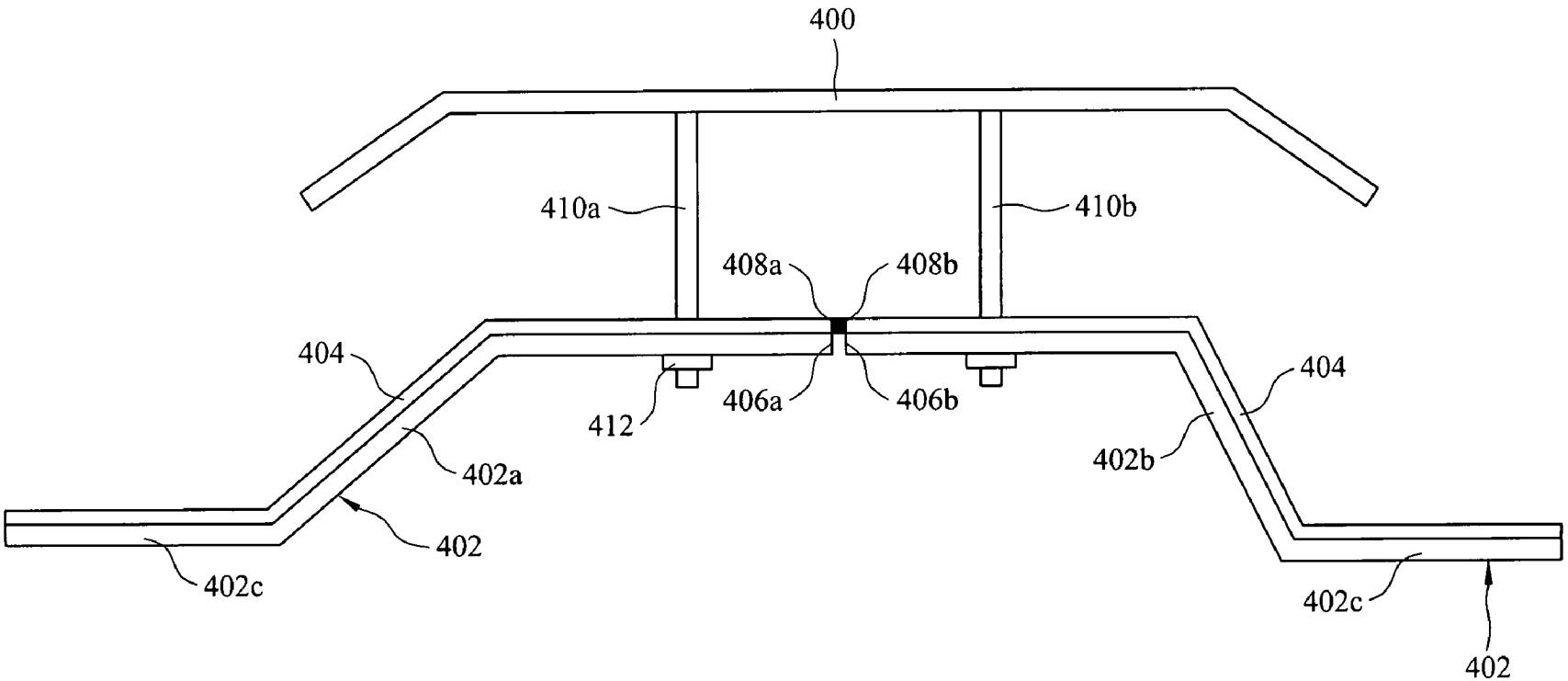
FIG. 4*b* is a cross-sectional view illustrating the thin keyboard structure of FIG. 4*a* deformed by a force.

FIG. 4*a* illustrates a cross-sectional view of a thin keyboard structure, in accordance with the second preferred embodiment of the present invention. FIG. 4*b* is a cross-sectional view illustrating the thin keyboard structure of FIG. 4*a* deformed by a force.

The structures illustrated in FIG. 4*a* and FIG. 4*b* are similar to the structures illustrated in FIG. 3*a* and FIG. 3*b* except for the magnitude of the included angles between the protruding portions and the base.

Referring to FIG. 4*a*, in the present embodiment, the thin keyboard structure comprises a substrate 402, a flexible circuit 404 and a keycap 400. The substrate 402 is made of a metal plate or a nonmetallic plate with elasticity, such as a plastic plate, an iron plate, an aluminum plate, a semiconductor plate or any arbitrary combination thereof. In the present embodiment, the substrate 402 is an elastic plate made of aluminum.

The substrate 402 comprises a base 402*c*, a first portion 402*a* with a first end 406*a*, and a second portion 402*b* with a second end 406*b*. The first portion 402*a* and the second portion 402*b* are connected with the base 402*c*, wherein at least one of the first portion 402*a* and the second portion 402*b* protrudes from the base 402*c* at an included angle of not equal to 90°. In the present embodiment, both of the first portion 402*a* and the second portion 402*b* protrude from the base 402*c*. There is an included angle of 120° between the first portion 402*a* and the base 402*c* and an included angle of 110° between the second portion 402*b* and the base 402*c*. That is, the two included angles are not equal to each other. The thickness of the protruding portions (the first portion 402*a* and the second portion 402*b*) is substantially 0.3 mm.

The first end 406*a* is aligned with the second end 406*b* and separated from the second end 406*b* by a distance. At least one of the first portion 402*a* and the second portion 402*b* is forced to deform, so that the first end 406*a* contacts the second end 406*b*.

The flexible circuit 404 comprises a first contact 408*a* fixed on the first end 406*a* and a second contact 408*b* fixed on the second end 406*b*. When the first end 406*a* contacts the second end 406*b*, the first contact 408*a* and the second contact 408*b* form an electrical connection. In the present embodiment, the flexible circuit 404 is a film circuit printed on the substrate 402. In some other embodiments of the present invention, the flexible circuit 404 is a flexible printed circuit fixed on the substrate 402. The first contact 408*a* and the second contact 408*b* are two metal protuberances connected to the flexible circuit 404.

The keycap has at least one connecting device fixed on at least one of the first portion and the second portion by fastener elements. For example, the keycap 400 has two connecting devices 410*a* and 410*b* fixed on the first portion 402*a* and the second portion 402*b* by two fastener elements 412, respectively. In the present embodiment, the lengths of the connecting devices 410*a* and 410*b* are different from each other.

Referring to FIG. 4*b*, when the keycap 400 is forced to push the connecting devices 410*a* and 410*b* downward, the first portion 402*a* and the second portion 402*b* protruding from the base 402*c* are deformed to electrically connect the first contact 408*a* and the second contact 408*b*.

When releasing the forced keycap 400, the deformed portions 402*a* and 402*b* return to their native positions by the elastic potential energy saved in the deformed portions to electrically disconnect the first contact 408*a* and the second contact 408*b*.

Figure 5A:
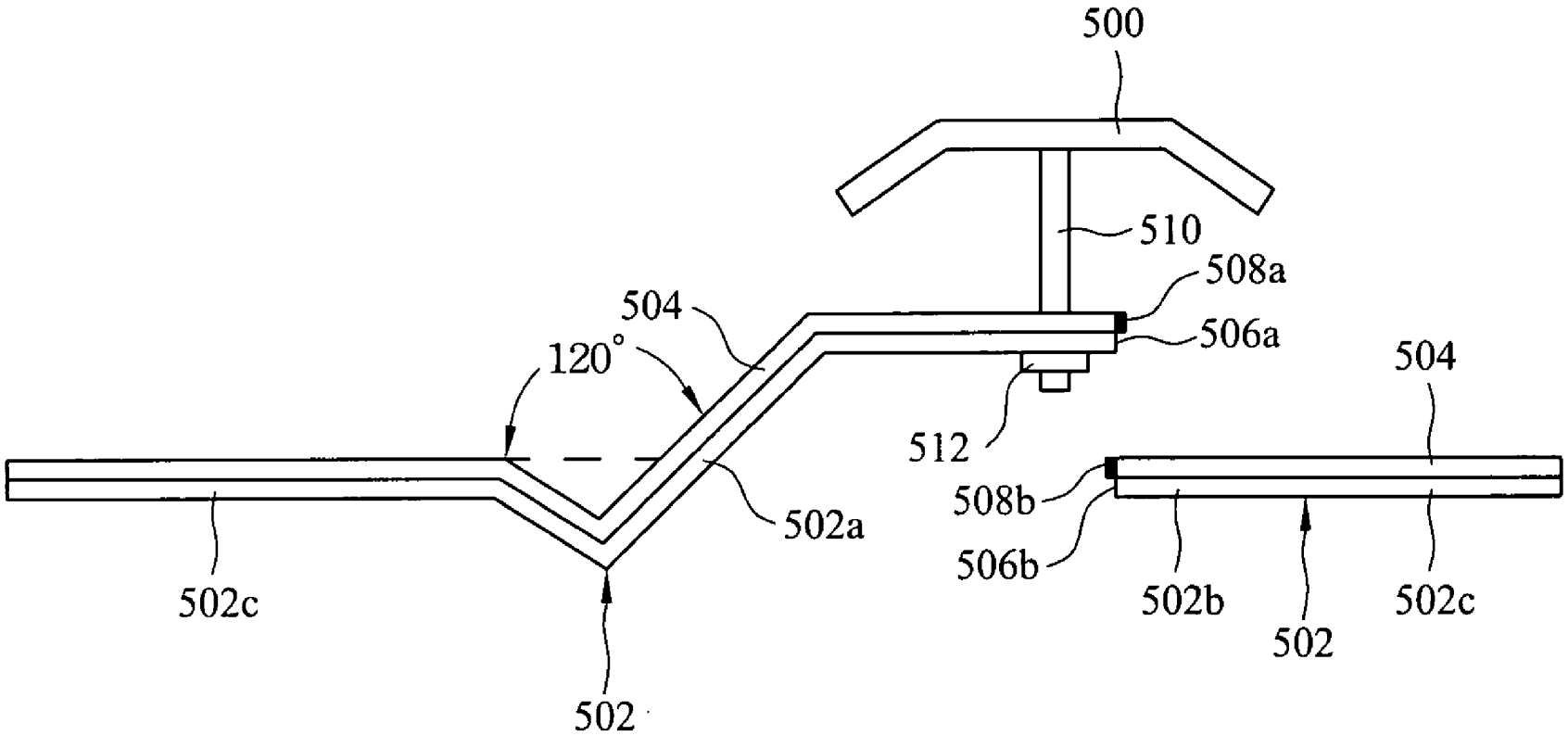
FIG. 5*a* illustrates a cross-sectional view of a thin keyboard structure, in accordance with the third preferred embodiment of the present invention.
Figure 5B:
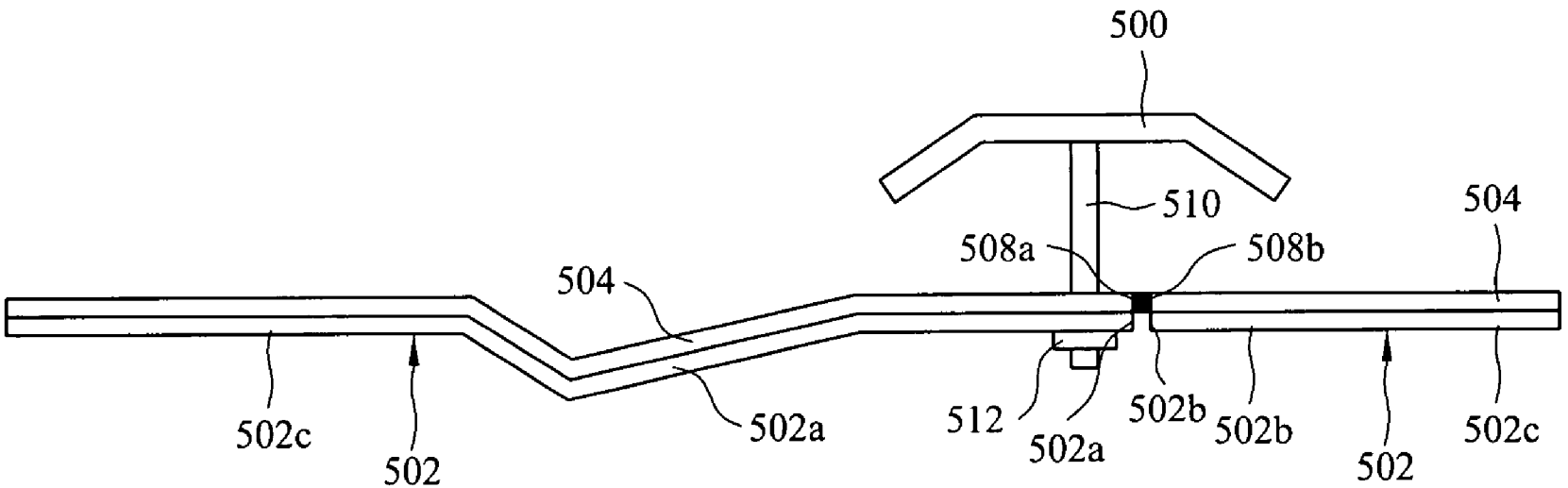
FIG. 5*b* is a cross-sectional view that illustrates the thin keyboard structure of FIG. 5*a* deformed by a force.

FIG. 5*a* illustrates a cross-sectional view of a thin keyboard structure, in accordance with the third preferred embodiment of the present invention. FIG. 5*b* is a cross-sectional view that illustrates the thin keyboard structure of FIG. 5*a* deformed by a force.

The structures illustrated in FIG. 5*a* and FIG. 5*b* are similar to the structures illustrated in FIG. 4*a* and FIG. 4*b* except for the magnitude of the included angles between the protruding portions and the base.

Referring to FIG. 5*a*, in the third preferred embodiment of the present invention, the thin press-button structure comprises a substrate 502, a flexible circuit 504 and a keycap 500. The substrate 502 is made of a metal plate or a nonmetallic plate with elasticity, such as a plastic plate, an iron plate, an aluminum plate, a semiconductor plate or any arbitrary combination thereof. In the present embodiment, the substrate 502 is an elastic plate made of aluminum.

The substrate 502 comprises a base 502*c*, a first portion 502*a* with a first end 506*a*, and a second portion 502*b* with a second end 506*b*. The first portion 502*a* and the second portion 502*b* are connected with the base 502*c*, wherein at least one of the first portion 502*a* and the second portion 502*b* protrudes from the base 502*c* at an included angle of not equal to 90°. In the present embodiment, only the first portion 502*a* protrudes from the base 502*c*, at an included angle of 120°; the second portion 502*b* is substantially coplanar with the base 502*c*. The thickness of the protruding portion (the first portion 502*a*) is substantially 0.3 mm.

The first end 506*a* is aligned with the second end 506*b* and separated from the second end 506*b* by some distance. At least one of the first portion 502*a* and the second portion 502*b* may be forced to deform to contact the first end 506*a* with the second end 506*b*.

The flexible circuit 504 comprises a first contact 508*a* fixed on the first end 506*a*, and a second contact 508*b* fixed on the second end 506*b*. When the first end 506*a* contacts the second end 506*b*, the first contact 508*a* is electrically connected to the second contact 508*b*. In the present embodiment, the flexible circuit 504 is a film circuit printed on the substrate 502. In some other embodiments of the present invention, the flexible circuit 504 is a flexible printed circuit fixed on the substrate 502. The first contact 508*a* and the second contact 508*b* are two metal protuberances connected to the flexible circuit 504.

The keycap has at least one connecting device fixed on at least one of the first portion and the second portion by fastener elements. For example, the keycap 500 has one connecting device 510*a* fixed on the first portion 502*a* by a fastener element 512.

Referring to FIG. 5*b*, when the keycap 500 is forced to push the connecting device 510*a* downward, the first portion 502*a* protruding from the base 502*c* is deformed to electrically connect the first contact 508*a* to the second contact 508*b*.

When releasing the forced keycap 500, the deformed portion 502*a* returns to its native position by the elastic potential energy saved in the deformed portion to electrically disconnect the first contact 508*a* and the second contact 508*b*.

Accordingly, the feature of the present invention is to utilize the elastic properties of the substrate to allow the first contact 508*a* and the second contact 508*b* to generate electrical signals, so as to replace the prior art elastic element and save material cost. Furthermore, the circuit of the keyboard may be integrated onto a single flexible printed circuit.

Therefore, the aforementioned embodiments provide a keyboard structure that reduces the cost and physical volume of the keyboard materials to achieve the objectives of the present invention.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structure.

What is claimed is:

1. A thin keyboard structure comprising:

a substrate having a base, a first portion with a first end and a second portion with a second end, wherein the first portion and the second portion are connected with the base; the first portion protrudes from the base at a first included angle; the first end is aligned with the second end and separated from the second end by a distance; the first portion may be forced to deform to contact the second end;

a flexible circuit having a predetermined circuit over the substrate, wherein the predetermined circuit comprises a first contact fixed on the first end and a second contact fixed on the second end, when the first end contacts the second end, the first contact electrically connects to the second contact; and a keycap having a first connecting device fixed on the first portion protruding from the base;

when the keycap is forced to push the connecting device, the first portion is deformed to electrically connect the first contact and the second contact;

when releasing the forced keycap, the deformed portion returns to its native position to electrically disconnect the first contact and the second contact.

2. The thin keyboard structure according to claim 1, wherein the substrate is selected from a group consisting of a plastic plate, an iron plate, an aluminum plate, a semiconductor plate and any arbitrary combination thereof.

3. The thin keyboard structure according to claim 1, wherein the second portion protrudes from the base at a second included angle.

4. The thin keyboard structure according to claim 3, wherein the keycap further comprises a second connecting device fixed on the second portion.

5. The thin keyboard structure according to claim 3, wherein the first included angle and the second included angle are substantially about 120°.

6. The thin keyboard structure according to claim 3, wherein the second portion has a thickness of substantially about 0.3 mm.

7. The thin keyboard structure according to claim 4, wherein when the keycap is forced to push the first connecting device and the second connecting device, the first portion and the second portion are deformed to electrically connect the first contact and the second contact.

8. The thin keyboard structure according to claim 3, wherein the second included angle is not equal to the first included angle.

9. The thin keyboard structure according to claim 1, wherein the second portion is substantially coplanar with the base.

10. The thin keyboard structure according to claim 1, wherein the thickness of the first portion is substantially about 0.3 mm.

11. The thin keyboard structure according to claim 1, wherein the flexible circuit is a film circuit that is printed on the substrate.

12. The thin keyboard structure according to claim 1, wherein the flexible circuit is a flexible printed circuit fixed on the substrate.

13. The thin keyboard structure according to claim 1, wherein the first contact and the second contact are two metal protuberances connected on the flexible circuit.

14. The thin keyboard structure according to claim 4, wherein the first connecting device and the second connecting device are fixed on the substrate by at least one fastener respectively.

* * * * *